US011735816B2

(12) United States Patent
Scarborough et al.

(10) Patent No.: US 11,735,816 B2
(45) Date of Patent: Aug. 22, 2023

(54) GAIN ROLL-OFF FOR HYBRID MECHANICAL-LENS ANTENNA PHASED ARRAYS

(71) Applicant: All.Space Networks Limited, Reading (GB)

(72) Inventors: Clinton P. Scarborough, Darlington, MD (US); Jeremiah P. Turpin, Linthicum, MD (US); Brian M. Billman, Baltimore, MD (US); John Finney, London (GB)

(73) Assignee: All.Space Networks Limited, Reading (GB)

( * ) Notice: Subject to any disclaimer, the term of this patent is extended or adjusted under 35 U.S.C. 154(b) by 357 days.

(21) Appl. No.: 16/865,123

(22) Filed: May 1, 2020

(65) Prior Publication Data

US 2020/0350681 A1 Nov. 5, 2020

Related U.S. Application Data

(60) Provisional application No. 62/842,905, filed on May 3, 2019.

(51) Int. Cl.
*H01Q 3/04* (2006.01)
*H01Q 19/06* (2006.01)

(52) U.S. Cl.
CPC ..... *H01Q 3/04* (2013.01); *H01Q 19/06* (2013.01)

(58) Field of Classification Search
CPC ..... H01Q 3/04; H01Q 19/16–062
See application file for complete search history.

(56) References Cited

U.S. PATENT DOCUMENTS 6,999,036 B2 * 2/2006 Stoyanov ..... H01Q 21/06 343/765
10,116,051 B2 10/2018 Scarborough et al.
2003/0090416 A1 5/2003 Howell et al.
(Continued)

FOREIGN PATENT DOCUMENTS

JP 10178313 A * 6/1998
JP H-10-178313 A 6/1998
(Continued)

OTHER PUBLICATIONS

International Search Report & Written Opinion for PCT/IB2020/054158, dated Jul. 1, 2020, 18 pages.

*Primary Examiner* — Andrea Lindgren Baltzell
*Assistant Examiner* — Amal Patel
(74) *Attorney, Agent, or Firm* — Wolf, Greenfield & Sacks, P.C.

(57) ABSTRACT

A hybrid mechanical-lens array antenna is described that can be configured with different orientations and arrangements of the plurality of lenses within the array to control and enhance the performance at different regions of scan. This can include the addition of a secondary array (a skirt) at a large tilt angle, tilting the primary array, tilting the individual lenses within the primary array, or any combination. These design choices, when holding the number of lens modules (and, therefore, cost and power consumption) constant, have the effect of changing the system height, reducing the boresight gain and increasing the gain at scan, with each option showing different trades of height and scan and boresight performance.

11 Claims, 7 Drawing Sheets

(56) References Cited

U.S. PATENT DOCUMENTS

| | | | | |
|---|---|---|---|---|
| 2007/0216596 | A1 | 9/2007 | Lewis et al. | |
| 2018/0115087 | A1 | 4/2018 | Besoli et al. | |
| 2019/0037416 | A1 | 1/2019 | Linehan | |
| 2020/0091622 | A1 * | 3/2020 | Turpin | H01Q 19/062 |

FOREIGN PATENT DOCUMENTS

| | | | |
|---|---|---|---|
| JP | 2008258772 | A | 10/2008 |
| RU | 2 599 901 | C1 | 10/2016 |

* cited by examiner

Elevation Plane: θ axis
Elevation: EL = 90°-θ
Horizon: EL=0°, θ=90°
Azimuth Plane - ϕ
121a
201
301
205
303

303
θ=90°
ϕ

121b
201
311
205
303

313
θ=90°
ϕ

121c
201
321
205
303

323
θ=90°
ϕ

121d
201
Tilted or
Skirt Lens
331
205
303

333
θ=90°
ϕ

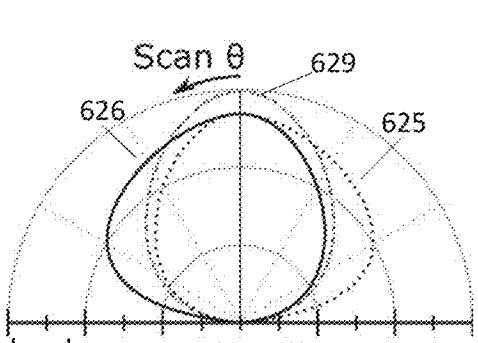
FIG. 6(a)
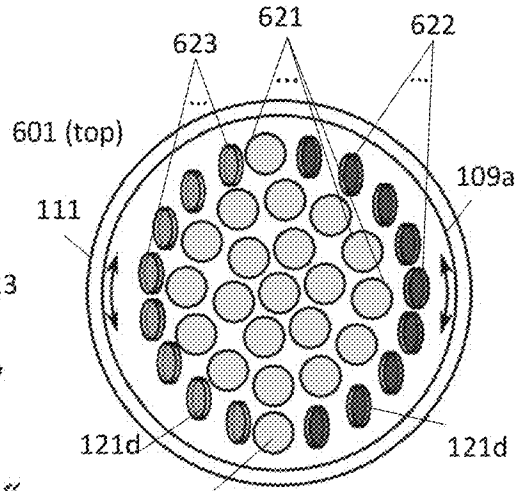
FIG. 6(b)
FIG. 6(c)

GAIN ROLL-OFF FOR HYBRID MECHANICAL-LENS ANTENNA PHASED ARRAYS

RELATED APPLICATION

This application claims the benefit of priority of U.S. Provisional Application No. 62/842,905, filed on May 3, 2019, the content of which is relied upon and incorporated herein by reference in its entirety.

FIELD

The present disclosure pertains to methods and systems for improving the gain roll-off over scan of hybrid mechanical-lens antenna phased arrays for satellite or terrestrial communications. The disclosure more specifically relates to methods and systems for configuring the lens elements with various tilting and rotating arrangements

BACKGROUND

Arrays of substantially planar elements suffer from gain degradation over elevation scan largely due to the reduction of projected antenna aperture area in the direction of scan. Gimbaled parabolic dish antenna and gimbaled flat panel antennas overcome this gain degradation through the use of two-dimensional mechanical motion to continuously point the entire antenna in the direction of desired scan. These gimbaled solutions result in very high-profile terminals that can be problematic or undesired in certain applications.

A phased array panel that is configured to electronically steer along one axis can be rotated to produce an antenna with coverage at all azimuth angles and across the achievable elevation-plane scan range of the panel. In this way, the azimuthal scanning axis is controlled mechanically, and the elevation axis controlled electrically. This reduces the height of a dual-gimbaled solution but introduces scan losses to far elevation scan angles. The elevation-plane scan range can be increased (or the scan losses reduced/gain at far scan improved) by tilting the panel towards the horizon in the same plane as the elevation-plane scanning axis. This increases the height but reduces the effective elevation-plane scan angle for pointing targets near the horizon.

A single-axis electrically-steered panel is much simpler and less expensive than a full two-dimensional scanning phased array, but has a narrow azimuthal beamwidth, which maintains the high requirements on pointing accuracy and response time on the mechanical actuators.

Phased arrays of electrically-reconfigurable RF lens modules, as in U.S. Pat. No. 10,116,051 to Scarborough et al., offer a number of advantages in power consumption and component count over conventional phased arrays for SATCOM, radar, and other purposes.

SUMMARY

The disclosure pertains generally to a radio-frequency lens array that employs tilted elements, tilted sub-arrays, and/or a degree of azimuthal mechanical scan to all or a subset of the lens elements. The addition of mechanical rotation allows for a reduction to the required scanning range, and therefore feed count, of each lens element. The azimuthal scan that the mechanical rotation provides also enables various configurations of tilted elements and tilted arrays. Tilting the individual lens elements and/or tilting the arrays provides improved gain performance at scan compared to a standard planar-phased array, while maintaining a low profile compared to gimbaled antennas.

In the simplest case, a planar array of a plurality of lens modules is mechanically rotated. This configuration allows for a significant reduction in the scan range, and therefore feed count, required of each lens element. The elements themselves primarily provide elevation scan with limited range of azimuth scan. The main azimuth scan is provided by the mechanical rotation. Unlike a standard phased array that has been configured for single-axis scanning, the lens array maintains a degree of two-dimensional scanning capability within the beamwidth of the lens element pattern (typically 5-15 deg). In this way, the antenna can electrically scan (for example) within any +/−5 deg cone of all points on the line between 0 and 65 deg parallel with the Azimuth=0 deg axis relative to the panel itself.

In order to increase scanned gain performance from the above configuration, the array can be tilted towards the horizon in a specified azimuth angle. The provides a larger projected area of the array facing the scan direction, thereby increasing the scanned gain.

Alternatively, or in combination with the described tilted array, each element within the array can be tilted towards a specified azimuth angle. This configuration reduces the scan requirement of each lens element thereby increase the element pattern gain at far scan angles.

Another configuration has two discrete lens arrays: a primary array and a secondary array. Each array can be configured with various combinations of array tilt, lens tilt, and mechanical rotation so as to focus scanning performance on different angular regions.

In one configuration, the primary array has planar elements that scan in both azimuth and elevation. A secondary array of lenses surrounds the primary array and the lenses are tilted outwards from the center of the antenna to supplement the gain at far scan angles (greater than 60 deg). Neither array uses mechanical motion.

Another configuration of the described antenna utilizes mechanical motion of both the primary and secondary array. The primary array may have planar elements, tilted elements, or a tilted array. The secondary array is configured along the perimeter of one-half of the primary array with all elements facing the same azimuth angle. Each element in the secondary array contributes additional gain performance at the specified azimuth angle while mechanical rotation of both the primary and secondary arrays provides azimuthal scanning. The feeds under both the primary and secondary array can be reduced to a single line of feeds or fewer such that each element mainly scans in elevation while the mechanical rotation scans in azimuth.

Another configuration has each individual lens tilted to various independent angles. The tilt variation provides grating lobe reduction, since there would not be a single, consistent element pattern and so generate constructive interference.

In all of the described cases, the transmit and receive signals from both the primary and secondary arrays are combined to provide a single beam.

BRIEF DESCRIPTION OF THE DRAWINGS

The accompanying drawings are incorporated in and constitute a part of this specification. It is to be understood that the drawings illustrate only some examples of the disclosure and other examples or combinations of various examples that are not specifically illustrated in the figures may still fall within the scope of this disclosure. Examples will now be described with additional detail through the use of the drawings, in which:

FIGS. 6(*a*)-(*c*) show a hybrid mechanical-lens array with a primary array and two secondary arrays pointing in opposite directions to allow for selective gain to be added to either side of the array and increase operational flexibility, and a related graph.

DETAILED DESCRIPTION OF THE INVENTION

This disclosure relates to specific design augmentations to a lens array antenna, such as for example the planar lens array in U.S. Pat. No. 10,116,051, to support design simplification, cost reduction, and increased design flexibility around trade between boresight and scan antenna gain performance. The entire contents of the '051 patent are herein incorporated by reference.

Figures 1A, 1B, 1C:
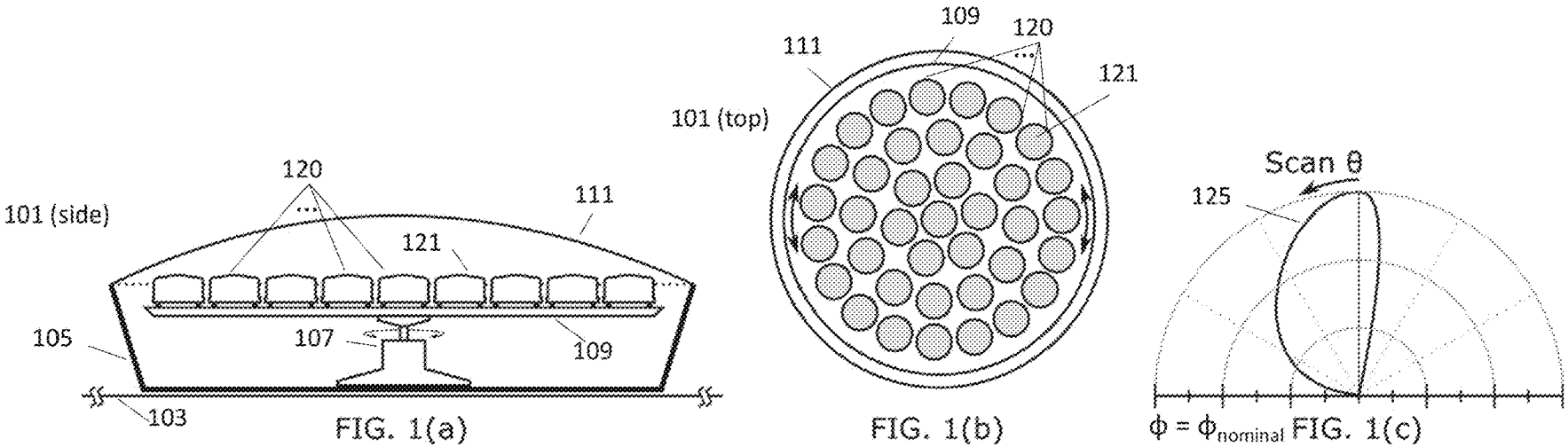
FIGS. 1(*a*)-1(*c*) shows a hybrid mechanical-lens array composed of a plurality of lens modules within a radome and housing, capable of being rotated azimuthally, and a related graph.

Referring to FIGS. 1(*a*), 1(*b*), the base hybrid mechanical-lens array antenna assembly 101 is shown (side view FIG. 1(*a*), top view FIG. 1(*b*)). This antenna is referred to as a hybrid since it uses a combination of electrical beamforming and mechanical steering to point beams across the overall field of view. The antenna 101 includes a substantially planar lens array 120, housing 105, rotation platform 109, and rotation actuator 107. The lens array 120 is formed by a plurality of lens modules 121 (sometimes referred to below as lenses) that are arranged to be substantially planar with one another, such that the array 120 is substantially planar, i.e., using non-spherical lenses filed on a plane. In one example embodiment, the lens modules 121 can have a bottom surface that is flat and a top surface that is slightly curved or curved, but the size of each individual lens module provides an overall combined top surface of all the lens modules 121 that is substantially planar. Referring to FIG. 1(*b*), the lens modules 121 can be circular, though any suitable shape can be utilized such as hexagonal. The actuator 107 rotates the array 120 about a vertical axis of 101 so that the antenna 101 can point beams in any azimuthal direction with lens modules 121 that can scan only over a limited subset of the azimuthal axis. The array 120 may be configured to be tilted at a fixed angle by the rotation platform 109 while being rotated by the actuator 107 in different applications, as will be discussed more fully with respect to FIGS. 4-7 below. Any suitable actuator 107 can be utilized, such as the one shown in U.S. Publ. No. 2020/0091622, the entire contents of which are hereby incorporated by reference.

The antenna 101 is mounted on a flat surface of the underlying support platform 103. For example, the support platform 103 can represent a tower, building roof or the roof of a car, boat, bus, or other vehicle where it may be desirable to install the antenna. The platform 103 may but is not necessarily level, in which case the boresight direction and scan angles of the terminal are relative to the orientation of the platform and the resulting orientation of the antenna 101. The antenna assembly 101 further includes a housing 105 that mechanically supports the rest of the structure (but is not RF-transparent) and an RF-transparent radome 111 that is removably attached to 105, protects the antenna from the elements, and allows the RF signals to propagate through. The housing 105 can be directly connected to the platform 103 via bolts or other fixtures. The housing 105 and the radome 111 jointly form a closed or sealed enclosure containing the antenna (e.g., lenses 121, platform 109 and actuator 107) to prevent moisture, dust, and environmental debris from interacting with the electrical and mechanical components of the antenna.

The rotation platform 109 can be relatively thin and have a flat top surface and a flat bottom surface. The lens array 120 is mounted to the top surface of the rotation platform 109, such that the flat bottom surface of the lens modules 121 engage the flat top surface of the rotating platform 109, either directly or indirectly (e.g., the lens modules 121 can be situated on and/or coupled to a flat substrate). The rotation actuator 107 has a base member and a connector that extends upward from the base. In one example embodiment, the connector can pivot and/or rotate with respect to the base member. The connector has a flat top surface that fixedly connects to the flat bottom surface of the rotating platform 109. In another example embodiment, the connector can rotate with respect to the base member, but does not pivot, and instead the rotating platform 109 is fixedly connected to the flat top surface of the connector at a fixed or adjustable angle.

Thus, the lens modules 121 in the array 120 are fixedly mounted on the rotation platform 109, and face substantially orthogonal to the plane of the rotating platform 109 and support platform 103. The beams communicated by those lens modules 121 are also substantially orthogonal to the plane of the rotating platform 109 and support platform 103. The rotation platform 109 is fixedly mounted to the connector of the actuator 107, and the base of the actuator 107 is fixedly mounted to the bottom surface of the housing 105. The rotation actuator 107 pivotally and/or rotationally mounts the rotation platform 109 to the housing 105, which in turn is fixedly mounted to the support platform 103. In particular, as shown by the arrows in FIG. 1(*b*), the rotating platform 109 can rotate axially about the center axis of the antenna 101.

FIG. 1(*c*) shows the gain profile relative to θ scan angle (plotted in polar coordinates). This scan profile is shown at a nominal ϕ value, and would be the same for every ϕ (Azimuth) angle as the rotation actuator 107 orients the array 120 in different directions. This allows the lens modules within the array to use feeds (see FIG. 2(*b*, (*c*)) that only allow scanning over a subset of azimuth angles (i.e., the lens cannot scan over 360 degrees, but only (for example) +/−90 degrees in azimuth (ϕ). Using only enough feeds to support a limited azimuth scan allows the total number of feeds (and therefore cost) to be reduced and optimized while maintaining the overall antenna scanning range with the assistance of the mechanical actuator. The graph shows, for this arrangement of lenses, that the highest gain from the antenna is at boresight (θ=0 deg), with gain dropping smoothly out to a maximum usable scan angle of about 65-70 deg.

Similar to most electrically-steered antennas, a drop in gain between 6 and 10 dB between boresight and 70 degrees is common. The reduced gain at scan is a result of the reduced effective aperture area (the projected area of the array 120 when viewed from 70 degrees is smaller than the projected area at smaller scan angles). Reduced gain indicates lower signal strength on signals received at angles at scan compared to boresight. This general behavior corresponds to the expected behavior by all beam-steering antennas, and is not distinct to this antenna.

Figure 2:
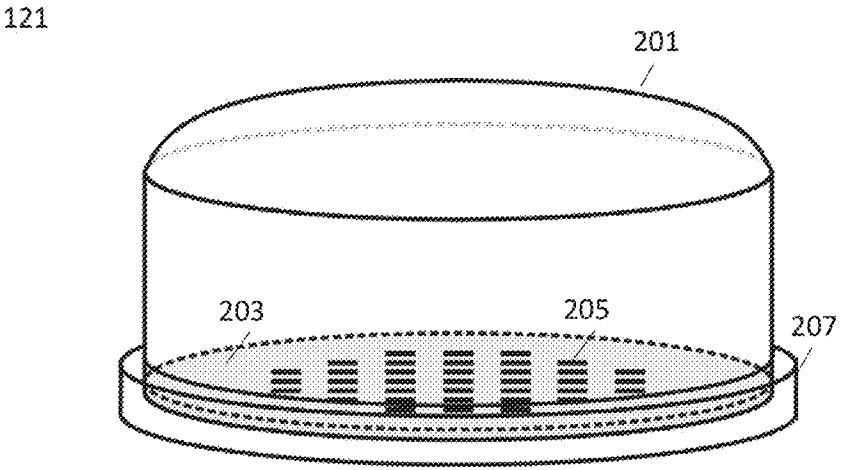
FIG. 2 is a single lens module showing the RF lens, feeds, feed board, and mounting structure.

Referring to FIG. 2, the lens modules 121 themselves each have an RF lens 201, a feed board 203, a plurality of feeds 205, and a mounting structure 207 by which the module 121 is attached to the rotation platform 109. The lens 201 is shown as having a circular outline, and with feeds closely spaced to the lens, but any suitable outline shape and spacing of the feeds can be provided within the scope of this disclosure. For example, different outlines, as well as non-zero gaps between the lens 201 and feed board, can be utilized.

Referring to FIG. 3, different example configurations and arrangements of feeds 105 are shown that may be used with the lens array antenna 101. In an individual lens antenna (e.g., a lens module 121 in a lens array 120) or reflector antenna, the location and number of the feeds dictate the range of angles which the resulting antenna beam may point. For example, a typical reflector antenna with a single feed fixed at the focus of the parabolic reflector can generate a single beam orthogonal to the reflector. In the same way, a lens module 121 with a single feed at the center of the focal region could generate a beam orthogonal to the lens. However, shifting that feed laterally within the focal region moves the beam in angle to a θ/ϕ related to the x/y location of the feed within the focal region. Adding multiple feeds within the focal region of the lens allows the specific feed to be selected in real time to generate a beam in a desired direction, as well as signals from adjacent feeds to be combined to allow fine-tuning of the beam direction and properties. In the following discussion, FIGS. 3(*b*), (*d*), (*f*), (*h*) are top views of the θ/ϕ space that illustrate accessible scanning angles of the relevant feed configurations.

Figures 3A, 3B, 3C, 3D, 3E, 3F, 3G, 3H:
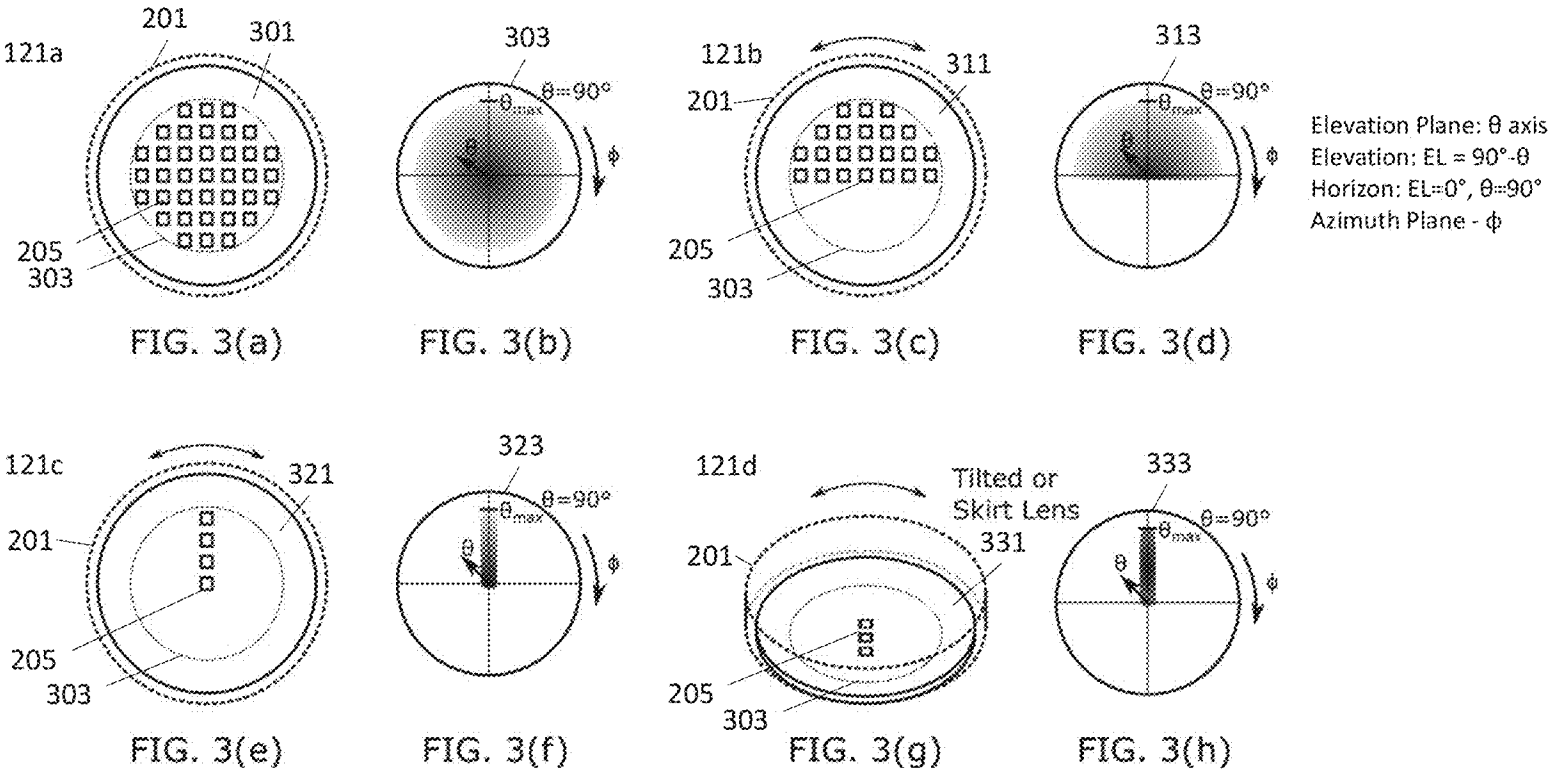
FIGS. 3(*a*)-3(*h*) show several variations of feed layouts, and related scan plots, for a lens module and illustrates the impact on accessible scanning range for a single lens, where FIGS. 3(*a*), (*c*), (*e*) are top views, and FIG. 3(*g*) is a perspective view.

In FIG. 3(*a*), fully populating the focal region 303 of the lens allows it to point a beam in any direction within the lens' field of view. As illustrated, the circular focal region 303 on the feed board 301 is completely filled with feeds. The available scanning range and relative gain strength 303 for a lens module 121*a* using feed board 301 is illustrated by FIG. 3(*b*), where the θ/ϕ plot is shaded in for all combinations of θ/ϕ where the lens can point a beam, with darker shade where the signal is strongest. The signal is strongest at boresight (center of FIG. 3*b*) since the lens has the strongest gain at zero scan (θ=0°).

In all cases, the feeds form a regular or generally uniform (hexagonal or rectilinear) grid, where spacing of the feeds is dependent on the properties of the lens, and are generally (but not exclusively) separated by approximately half a wavelength at the operational frequency of the antenna for optimal scanning performance and resolution of the resulting beams.

Several example broad classes of alternate feed arrangements that trade reduced feed count and cost compared to FIG. 3(*a*) for reduced angular scan coverage range are illustrated in FIGS. 3(*c*), (*e*), and (*g*), and their corresponding angular scanning ranges in FIGS. 3(*d*), (*f*), and (*h*).

Referring to FIG. 3(*c*), the lens module 121*b* with feed board 311 shows approximately half of the focal region 303 populated with feeds 205, with the benefit of lower cost (due to fewer circuits required to support the reduced feed count) compared to 121*a*. More specifically, the feeds 205 are arranged in the upper half of the feed board 301 in a half-circle pattern. That configuration results in a scanning range 313 that covers approximately the upper hemisphere, plus a small region of the lower hemisphere. This lens module 121*b* cannot scan the ϕ space (limited as shown to able to electrically scan only for −90°<=ϕ<=90°) except by the addition of azimuthal-plane mechanical rotation via a rotation actuator 107 under the array overall. However, the capability for two-dimensional electronics scanning within the upper hemisphere as shown greatly reduces the scanning speed and accuracy required of the mechanical actuator 107.

In this case, the actuator 107 can rotate the lenses 121*b* to track movement of the target sufficient to keep the desired beam target inside the accessible region 313, rather than needing to track the target satellite or communications target to a 0.2 degrees of accuracy as a conventional gimbaled antenna for SATCOM purposes would require. Even with substantial (>1-5 degrees) pointing error in the mechanical actuator, the antenna as a whole will meet the required accuracy and fast scanning response time via the electronic scanning, and access to the full range of ϕ angles through rotation supported by the actuator 107. Full antennas 101 constructed using this module 121*b* can support multiple beams connecting to different satellites, since the mechanical rotation of the array 120 containing the modules 121*b* needs only to point the center of the coverage region towards the midpoint of the two or more satellites. Any two, and many configurations of three or more satellites (particularly geosynchronous satellites that will always be all-north or all-south of the antenna) can be simultaneously addressed by this configuration.

Referring to FIG. 3(*e*), the number of feeds 205 can be reduced further as shown by module 121*c* using feed board 321, which only uses a single line of feeds starting near the center and extending to the edge of the focal region 303. As shown in FIG. 3(*f*), in the coverage range 323, this configuration allows the lens module 121*c* to scan only within a narrow azimuthal (ϕ-axis) cone of +/−5-15 deg (depending on the lens size relative to the wavelength and other properties), but across the full range of scan angles supported by the lens 201 and focal region 303. For this lens module 121*c*, the dependence on azimuth is much stronger than for 121*b*, and only a single beam for a single target is reasonable usable. Multiple beams could be generated, but they would need to be within +/−5-15 deg of each other in the azimuthal plane, which would be a much more limiting constraint.

A variation on the case 121*c* (FIG. 3(*e*)) is possible when the lens module is tilted such that the boresight direction for the lens itself is at a nonzero scan angles θ in the elevation plane relative to the axis of rotation and the boresight direction of the antenna overall. If the lens module 121*d* (FIG. 3(*g*)) is pointed down towards the horizon (or any θ angle greater than 0 degrees, but typically between 45 and 70 degrees), then the line of feeds 205 under the lens can be shifted to the center of the focal region 303 and still cover the same range of angles. The benefit of tilting the lens and shifting the feeds to match is that the lens is operating at lower scan angles θ on average, thus operating with increased gain. That is, the feeds 205 on the feed board 331 for tilted lens module 121*d* are adjacent to one another at the center of the focal region and do not extend to the edge of the focal region 303, rather than extending from the center of the focal region to the edge of the focal region as in 121*c*. This shifts the location in the elevation plane where the highest gain from the lens module 121*d* is obtained. As shown in the coverage range 333, the highest (darkest shade) gain occurs partway between 0 and $\theta_{max}$. As will be discussed more fully below with respect to FIGS. 4-7, the tilting angle of the lens controls the angle of maximum gain of the element pattern.

In all of these cases, reducing the number of feeds 205 by removing feed elements (for example) from the lens assemblies 121*a* to obtain a modified configuration (such as lenses 121*c*) reduces the scanning range of the lens module 121, but doesn't directly reduce or affect the gain of the lens module within the remaining accessible scan range. Since the feeds are only enabled if the antenna is pointing in the direction covered by the feed, removing a feed simply means that that feed cannot be enabled (meaning the antenna cannot point in the directions supported by the feed), and the remaining feeds can be selected and operate normally. Any of the cases that restrict the scanning range in the azimuthal direction then require mechanical rotation of the lens, feeds, or entire array (by an actuator 107) in order to point beams anywhere within the ordinary scanning range of the lens (i.e., to scan in directions where corresponding feeds have been removed). Any necessary motion in these cases can be accomplished with only a single axis of low-resolution, relatively low-accuracy rotational motion driven by a rotation actuator 107, rather than multiple dimensions of high-precision actuators as required for a gimbaled parabolic reflector antenna. Here, low-resolution and low-accuracy are evaluated relative to that required for a multiaxis gimbaled SATCOM parabolic antenna, which requires accuracy better than 0.2 deg in all axes at all times, with very high constraints on tracking speeds and acceleration to follow both the platform 103 and potential satellite motion.

Referring to FIG. 4, another example embodiment of the antenna assembly 401 (side view in FIG. 4(*a*), top view in FIG. 4(*b*)) shows the effect of splitting the lens modules 121 in the array 120 into a primary array 421 composed of a plurality of lens modules 121*c* (FIG. 3(*e*), though it also can be utilized with the configuration of lenses 121 shown in FIGS. 3(*a*), (*c*), (*g*)), and a secondary or skirt array 423 composed of a plurality of tilted lens modules 121*d*. The rotation platform 409 has a primary section 409*a* and a secondary section 409*b*. The secondary section 409*b* is angled or tilted in elevation with respect to the primary section 409*a*, and specifically the secondary section 409*b* is angled downward with respect to the primary section 409*a*. The primary section may be a thin flat planar board to which the primary array 421 of primary lens modules 121*e* are mounted. The primary section 409*a* is in a primary plane that is substantially parallel to the plane of the bottom of the housing 105 and the plane of the support platform 103. The secondary section 409*b* is a thin flat planar board to which the secondary array 423 of secondary lens modules 121*d* are mounted. The secondary section 409*b* is in a secondary plane that is angled or tilted with respect to the primary plane, forming a skirt around the left face (in the embodiment shown) of the array.

Thus, in the example embodiment of FIG. 4, the secondary section 409*b* extends partially about the outer periphery or perimeter portion of the primary section 409*a* of the rotation platform 409. The secondary portion 409*b* can have a curved shape, such as a partial C-shape, or can have a crescent shape or other suitable shape. The primary portion 409*a* and the secondary portion 409*b* together form a complete circle, though any suitable sizes and shapes can be utilized, whether or not the shapes and sizes of the portions 409*a, b* match or align with each other. And the primary portion 409*a* can be integral with or separate and coupled to the secondary portion 409*b*. In addition, the secondary portion 409*b* can be moved from a first position aligned and coplanar with the primary portion 409*a*, and a second position angled or tilted with respect to the primary portion 409*b*, such as about a hinge, or be fixed in place.

As further illustrated by the example embodiment of FIG. 4, the secondary portion 409*b* can be arranged so that the feeds and scanning range as defined by the feed board 331 in the secondary lens modules 121*d* are aligned with the scanning axis of the line of feeds 205 on the feed board 321 of the primary lens modules 121*c* in the primary array 421. Thus, the secondary portion 409*b* is to the side of and below the primary portion 409*a*. Both arrays 421, 423 continue to be supported and rotate together with the rotation platform 409. The signals from both the primary and secondary array elements 121*e, f* are combined to form a single beam in either transmit and receive operation. And while a single secondary array 423 is shown only along a portion of the perimeter of the primary array 421, any number of secondary arrays 423 can be provided either continuous and contiguous (i.e., as close as possible to be adjacent to and/or touching) with the primary array 421 (as shown), or separated from the primary array 421 by a gap or distance, and can extend along the enter outer perimeter of the primary array 421 or a lesser portion of the primary array 421 than shown.

The effect of splitting into two arrays 421, 423 and configuring the secondary array 423 as a skirt partway around the perimeter of the array is that at scan angles close to the tilt angle of the skirt (typically between 45 and 70 degrees relative to boresight), the lens modules 121*d* in the secondary (skirt) array 423 are nearly boresight to the desired beam, and therefore do not suffer from scan losses as do the lens modules in the primary array 421. Thus, the primary section is in a primary plane and the secondary portion is in a secondary plane, and the planes are at an acute angle of about 45-70 degrees to one another. Thus, the planes are at an angle to be offset from one another. As illustrated in FIG. 4(*c*), the gain 425 at boresight of the primary array 421 drops somewhat compared to the performance 125 (shown in dashed line) of the original planar reference array 101 due to the reduction in the number of boresight-pointed lenses. However, the gain at scan improves significantly. Even though the number of secondary lenses 121*d* in the skirt can be relatively small compared to the primary lenses 121*c*, the large scan losses seen between (for example) 0 and 70 degrees are enough to allow a smaller number of lenses to add a significant boost to performance at far scan angles. This has the effect of flattening the gain roll-off curve, and increasing the scan angles for which the gain is high enough to meet a given threshold (such as 3 dB, 4.5 dB, 7 dB, etc.).

It is an interesting result that, the worse the original roll-off (difference between boresight and scanned gain) of the lens module itself, the better the impact and gain improvement at scan is available for the skirt secondary array 423. This means that skirt array 423 should be targeted at or close to the edge of scan (in 333) for the primary array 421 to maximize the improvement while minimizing the sacrificed boresight gain. This means that a skirt targeted at a low scan angle, such as 30 degrees, will provide very little apparent benefit, since the scan losses to 30 degrees are typically small to moderate, and targeting a skirt array beyond the scanning range of the primary array 421 (such as about over 70 degrees or even 75-85 degrees) will require the skirt array to be very large in order to maintain performance, since it will no longer be assisting the primary array. For these reasons, the best angles for the skirts fall between 45 and 70 degrees, since smaller angles show smaller benefit, and larger angles go past the supported range for the primary array.

Figures 4A, 4B, 4C:
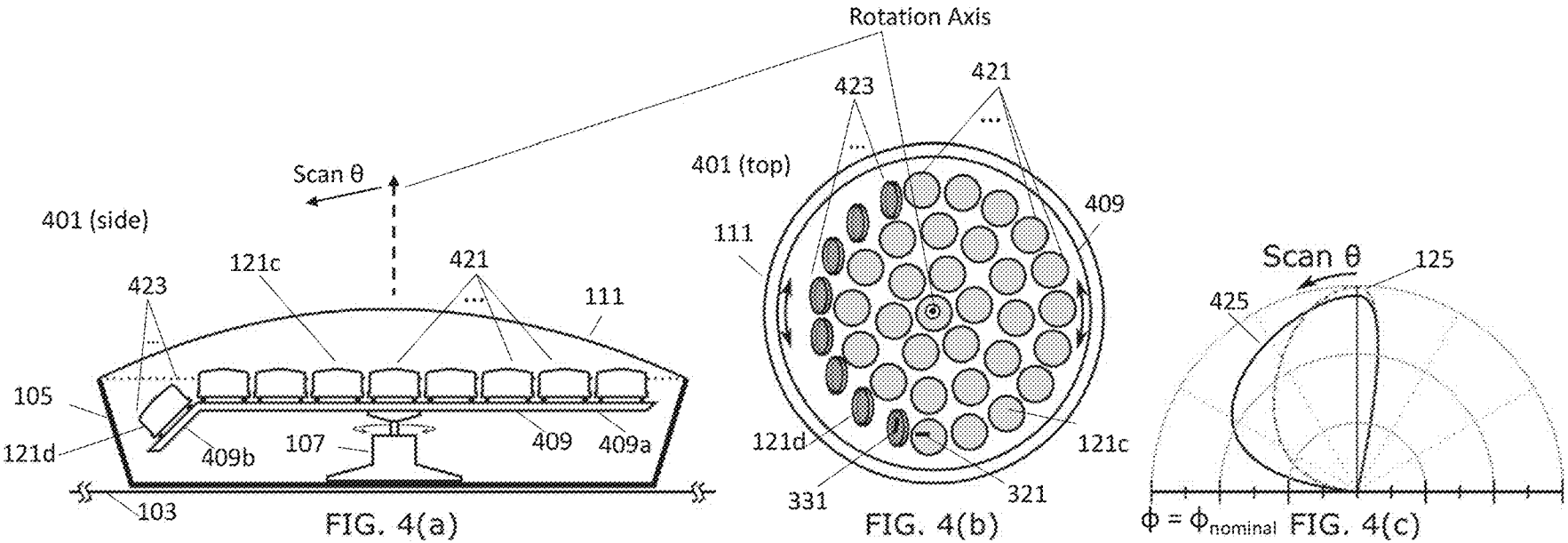
FIGS. 4(*a*)-(*c*) show a modified hybrid mechanical-lens primary array with an added secondary array (a "skirt") of lens elements tilted towards the horizon to extend the scanning performance of the antenna, and a related graph.

It should also be noted that the relative size of the primary array 421 and the secondary array 423 (measured in number of lens modules as well as aperture area) are subject to some constraints. The impact of the skirt is highest when the number of lenses in the skirt is on the order of 3-9 dB (½ to ⅛) of the number of lenses in the primary array. Depending on the number of modules in the primary array 421, this might be satisfied by one or multiple stacked layers of skirts; single layers are more convenient, since multiple layers (while possible) increase the height of the antenna and are therefore less desirable. This places upper bounds on the size of the array that can practicably include an effective single-level skirt, as illustrated in FIG. 4. The number of lenses increases with the square of aperture diameter, but the number of lenses available in the skirt (proportional to circumference) increases only linearly with the aperture diameter—in larger arrays, the skirt has so few elements relative to the primary array that there is little to no impact, and it is not useful. In one example non-limiting embodiment, a fraction of lens modules in the secondary array 423 is between 12-35% of the number of modules in the primary array 421. For example, 12 out of 50 lenses, or 8 out of 38 (as shown in FIG. 4*b*) are reasonable ratios.

Figure 5:
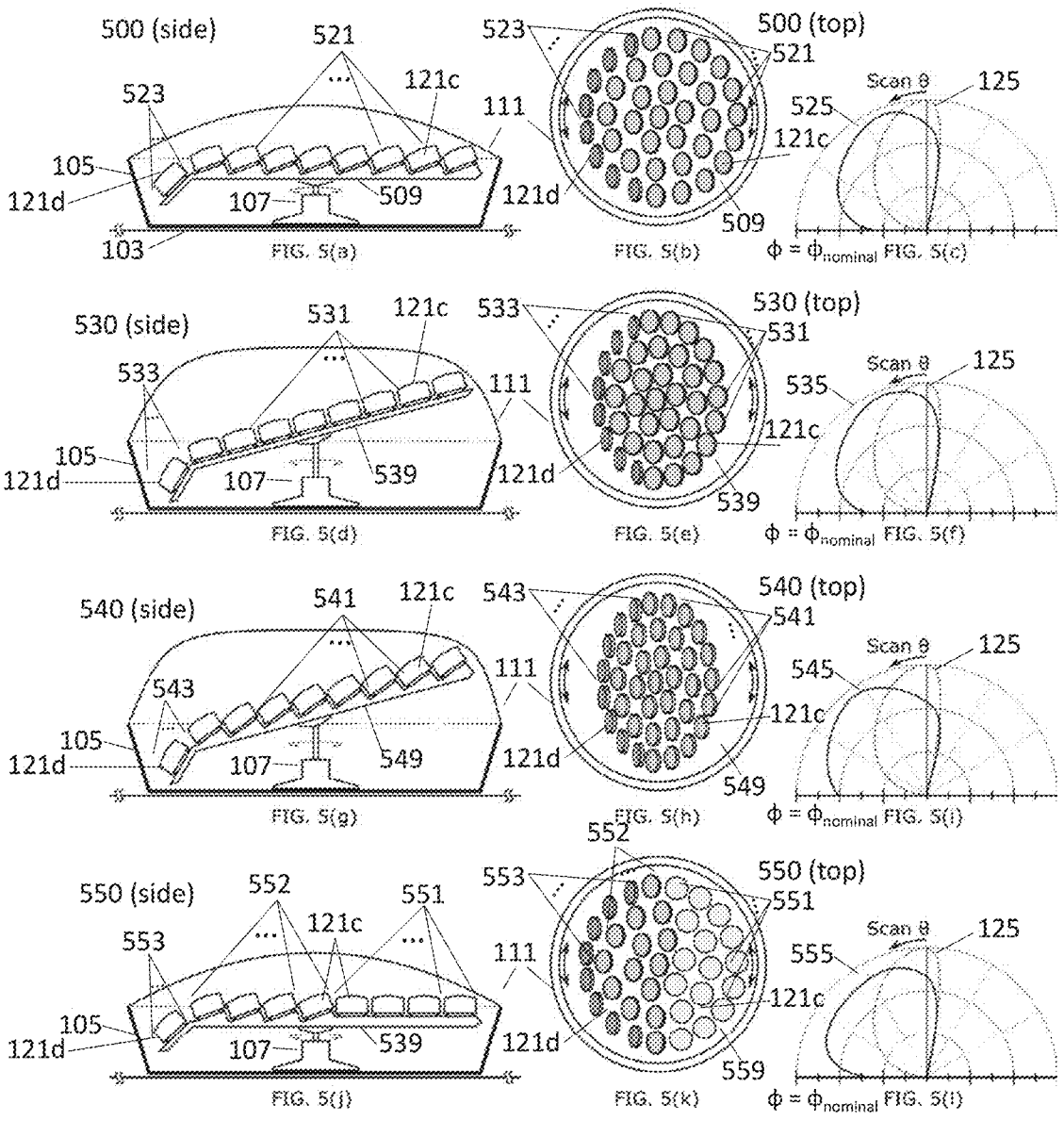
FIGS. 5(*a*)-(*l*) show variations of hybrid mechanical-lens arrays with different methods and combinations of tilting both the primary and secondary arrays of lens modules, and related graphs.

To extend the elevation-plane scanning range of the antenna beyond that of the individual lens 201 and lens module 121, it is necessary to further modify the primary array. Referring to FIG. 5, a set of four example variations are shown that increase the scanning range of the terminal. For individual lens modules that can scan to 60 or 70 degrees, these approaches can enable antennas that can scan with good performance in the elevation plane to 80 or 90 degrees.

The variation antenna assembly 500 (side view in FIG. 5(*a*), top view in FIG. 5(*b*)) uses a primary array 521 and a secondary array 523, but tilts all of the lenses 121*c* (FIG. 3(*e*), though again this can also be utilized with the configuration of lenses 121 shown in FIGS. 3(*a*), (*c*), (*g*)) in the primary array 521 slightly towards the horizon by modifying the rotation platform 509. As shown, the lenses 121*c* are placed at an angle or tilt with respect to the bottom surface of the housing 103 and the support platform 103. As shown, the top surface of the platform 509 is formed with angled ridges or shelves in a sawtooth type of arrangement, and the lenses 121*c* are mounted to the angled side of the top surface. Of course, any other suitable technique can be utilized to position one or all of the lenses 121*c* at an angle with respect to the central plane of the platform 509 or the plane of the bottom of the housing 105 or the support platform 103. For example, the top surface of the rotation platform 509 can be flat, and shelves can be mounted to the top surface of the rotation platform 509, or the lens modules 121*c* can have a base that angles the lenses 201.

The angled lenses 121*c* shift the coverage region towards the horizon by the amount of the tilt. This is illustrated by the coverage range 525 in FIG. 5(*c*). There is a limit on how much tilt can be applied to the lenses individually without one lens blocking the neighbor, and it is challenging for this method to produce overall improved performance past about 75 degrees due to the geometry of the lenses. As in the antenna assembly 401, the secondary array 523 in the assembly 500 continues to support the scanning response at the far scan. The significant impact of this variant is that the gain is no longer highest at the antenna boresight.

The example variation of antenna assembly 530 (side view in FIG. 5(*d*), top view in FIG. 5(*e*)) shows the effect of tilting the entire primary array 531 of lenses using the rotation platform 539, while maintaining the secondary array 533. That is, in one non-limiting embodiment, the platform 539 is fixedly mounted to the actuator 107 at an angle. In another embodiment, the actuator 107 can tilt or pivot the rotation platform 539 so that one end of the rotation platform is higher than the other end. Tilting the entire array increases the system height significantly, but does not contribute to blockage between adjacent lens modules 121*c* in the primary array. The gain performance 535 (FIG. 5(*f*)) is slightly better than from tilting the lenses alone 525, but shows similar behavior.

Both of the previous approaches can be combined; example variation antenna assembly 540 (side view in FIG. 5(*g*), top view in FIG. 5(*g*)) shows the impact of tilting the entire primary array 541 as well as the lenses 121*c* within the array, in addition to the secondary skirt array 543. The primary 541 and secondary 543 arrays are both supported in the desired location by the rotation platform 549. This approach allows extension to the antenna scan range without blockage between adjacent lenses 121*c* in the primary array 541, and further supports the scanning performance in the middle of the scanning range. With increased scanning range, the location and height of the housing 105 and the transmission angular response of the radome 111 may become limiting factors. This configuration offers the opportunity to maximize the performance at scan as a trade for significant performance reduction at boresight as shown in the representative coverage plot 545 (FIG. 5(*i*)).

Another example variation antenna assembly 550 (side view in FIG. 5(*j*), top view in FIG. 5(*k*)) shows a combination of two primary arrays 551 and 552, with 551 oriented towards one angle, 552 tilted at a different angle, and finally a skirt secondary array 553 applied. This combination (and others like it) can be tuned to produce a specific scanning profile; the coverage range 555 (FIG. 5(*l*)) shows an example of nearly flat gain between 20 and 70 deg. Changes to the relative number of lens modules 121*c* and 121*d* in each array 551, 552, 553 and the degree of tilting or other effect included can be used to shape and control the gain roll-off experienced by the antenna 550 overall. Thus, as illustrated here, the lenses 121 within a same array (e.g., primary array or secondary array) need not point or be angled in the same direction, but can point or be angled or tilted in different directions. That is, lenses 551 are angled in a first direction and lenses 552 are angled in a different direction, both installed on the rotation platform 559. Still further, the lenses 551 could be angled in an opposite direction (e.g., to the right in the embodiment shown) to the lenses 552.

Referring to FIG. 6, an antenna 601 can be constructed using a single primary array 621 of lens modules 121 and two secondary arrays 622 and 623 oriented in different azimuthal directions, here (side view in FIG. 6(*a*), top view in FIG. 6(*b*)) shown in opposite directions ($\phi$=0 deg and $\phi$=180 deg). In this case, the skirt array 622 might be composed of lens modules configured for receive-only, and the skirt array 623 might be composed of lens modules configured for transmit-only. These restrictions might be made to reduce cost or complexity, or due to fundamental limitations in the circuitry. By including both transmit and receive skirts on opposite sides of the array, the end-user of the antenna has the option to have performance (referring to FIG. 6(*c*)) in either receive-boosted 625 (orient the antenna with the rotation actuator 107 towards the receive skirt 622) or transmit-boosted 626 (orient the antenna with the rotation actuator 107 towards the transmit skirt 623) modes. This configuration is of the most interest in height-constrained applications where the height of adding a second skirt layer that would provide the transmit and receive performance simultaneously was undesirable, but operational flexibility was desired.

In each of the cases above, the rotation platform 107 is shown as one piece between the primary and secondary arrays. In all cases, a separate rotation platform could be used for the primary and secondary arrays (e.g., the primary array mounted to a primary rotation platform and the secondary array mounted to a secondary rotation platform that rotates independent (either in the same direction or opposite direction) of the primary rotation platform), supporting each lens module either integrally or separately from the others. The separate rotation platforms (if used) can be integrally formed with the first platform, or separate and discrete from the first platform and fixedly, removably and/or dynamically rotatably coupled with the first platform. For example, one rotation platform can be concentrically positioned inside the other rotation platform, or on top of the other platform. Thus, each element can be at a fixed tilt or a dynamically adjustable tilt in unison with or separately from each other element. The lens elements in the secondary array are tilted at an angle that may be the same or different from the tilt angle of the primary lenses. Both the primary and secondary array are mechanically rotated to provide azimuth scanning.

Figure 7A:
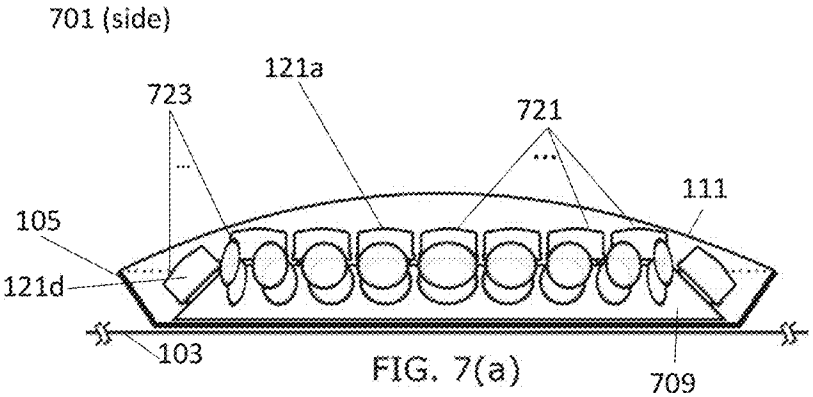
FIGS. 7(*a*)-7(*c*) show the effect of a skirt of lenses added around a planar array without mechanical rotation, and a related graph.
Figure 7B:
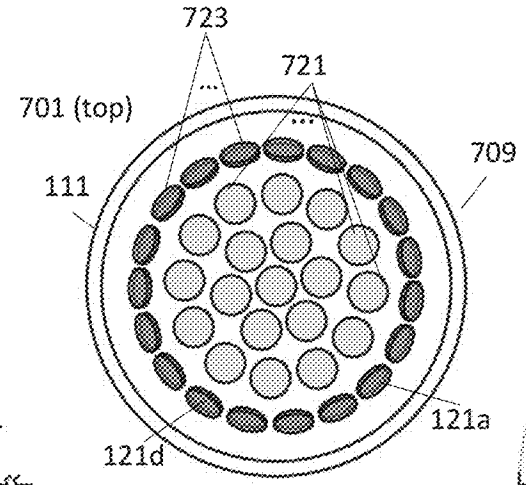
Figure 7C:
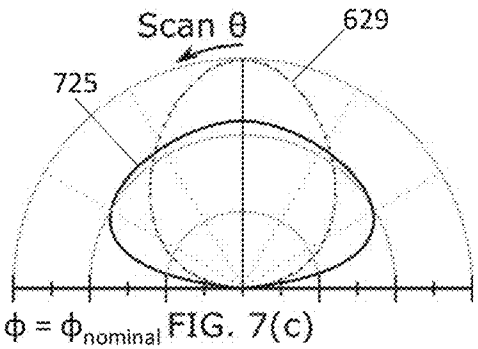

As an extension of the skirt concept, a skirt secondary array may be applied to a fixed or non-rotating antenna 701 (referring to side view in FIG. 7(*a*) and top view in FIG. 7(*b*)) with primary array 721 composed of lens modules 121*a* with fully-populated focal planes 303 of feeds 205. The secondary skirt array 723 is then added radially on the perimeter of the primary array 721, supported by the structure 709, and composed of lens modules 121*d* with elevation-plane scan range adjusted to the angle of the skirt. The effect (referring to FIG. 7(*c*)) of this arrangement of lens modules as seen in the roll-off diagram 725 is to substantially reduce the boresight gain but also to flatten the gain rolloff to give a very flat response with elevation plane scan angle θ centered about boresight. The addition of additional skirt layers or adding radial tilt angles to the lens modules 121 in the primary array 721 converts the skirt array to a domed array, which allows further control over the rolloff profile in exchange for reduction in peak gain and increase in antenna height.

In each of the embodiments discussed above, the primary and secondary arrays each have circuitry and control capability as is standard to individually point a beam or beams in the commanded elevation and azimuth relative to the orientation of the rotation platform 109. In addition, a joint controller and circuitry is included to combine the signals from the separate primary and secondary arrays to as to form a single beam from the combined arrays.

In each of the embodiments discussed above, the mounting platforms and support stages are substantially flat planar members having a flat top surface, and one or more elements of the array are fixed or coupled to the respective platform or support stage. However, in other embodiments, the platforms and support need not be planar.

It is further noted that with respect to FIGS. 1-7, the actuator 107 rotates the lenses 121 and platform 109, 409, 509, 539, 549 between a first position having a first azimuth, and a second position having a second azimuth. The first azimuth can be different than the second azimuth, overlapping with the second azimuth, or a subset of the second azimuth, as desired for a particular application. The different positions enable the user to achieve a desired scan coverage up to a complete 360 degrees. And, the platform 109, 409, 509, 539, 549 can be fixed to the actuator 107 at a first angle or a second angle that differs from the first angle. The first angle or position can have a first elevation and the second angle or position can have a second elevation that is the same as or different than the first elevation. For example with respect to FIG. 3(*c*), the actuator 107 can rotate the lenses 121*b* from a first position shown in FIG. 3(*c*) with the lenses in the upper half, and a second position with the lenses in the lower half, to provide a complete 360 degrees of scan coverage.

In addition, in one embodiment, the actuator 107 can be rotated manually and fixed in position. And the secondary portion of the rotation platform 409 can be formed at a fixed angle to the primary portion of the rotation platform 409. However, in another embodiment, a processing device such as a controller, processor, computer, or the like, can be provided to control rotation of the actuator 107, either under control of the user or automatically. And, the secondary portion 409*b* of the rotation platform 409 can be pivotally or rotatably coupled to the primary portion 409*a* of the rotation platform 409, such as for example by a hinge, and the user can manually rotate the secondary portion 409*b* with respect to the primary portion 409*a* between the first and second angles to a suitable angle or to be planar, or a processing device can control that movement automatically or under user control. Likewise, the top surface of the platform 509 can be integrally formed at fixed angles or can pivot with respect to the platform 509 to be individually adjustable manually or by the processing device.

The embodiments above describe and illustrate the arrays and apertures as circular or approximately so. Circular arrays are convenient when using rotation, since circular apertures are efficient in terms of gain for the size of the region traversed by the rotating structure (when compared with a rectangle, for example). However, the details described above can be applied to arrays and antennas of any shape and outline.

Any frequency band can be used, and the most flexible system would be when the antenna and system can operate at and listen to different frequency bands. However, electrically-steered antennas that operate at multiple frequencies are difficult to build and are expensive. So, most practical systems will operate at a single band, with the most common communications systems bands being Ka and Ku for VSAT operation.

This disclosure, although described primarily as being used for SATCOM purposes, may be applied for different applications within communications and remote sensing, such as reconfigurable or mobility point-point microwave links, radar, 5G, etc.

As used in this specification and the appended claims, the singular forms "a", "an" and "the" include plural referents, unless the context clearly dictates otherwise. Similarly, the adjective "another," when used to introduce an element, is intended to mean one or more elements. The terms "comprising," "including," "having" and similar terms are intended to be inclusive such that there may be additional elements other than the listed elements.

Additionally, where a method described above or a method claim below does not explicitly require an order to be followed by its steps or an order is otherwise not required based on the description or claim language, it is not intended that any particular order be inferred. Likewise, where a method claim below does not explicitly recite a step mentioned in the description above, it should not be assumed that the step is required by the claim.

It is noted that the description and claims may use geometric or relational terms, such as right, left, upper, lower, top, bottom, linear, curved, parallel, orthogonal, concentric, crescent, flat, planar, coplanar, etc. These terms are not intended to limit the disclosure and, in general, are used for convenience to facilitate the description based on the examples shown in the figures. In addition, the geometric or relational terms may not be exact. For instance, walls may not be exactly parallel to one another because of, for example, roughness of surfaces, tolerances allowed in manufacturing, etc., but may still be considered to be perpendicular or parallel.

Numerous applications of the present system and method will readily occur to those skilled in the art. Therefore, it is not desired to limit the invention to the specific examples disclosed or the exact construction and operation shown and described. Rather, all suitable modifications and equivalents may be resorted to, falling within the scope of the invention,

The invention claimed is:

1. An antenna system comprising:

a substantially planar first phased array of radio-frequency lens modules, each of the lens modules configured to scan in a first azimuth;

a mechanical actuator, having a platform, the lens modules fixedly mounted to the platform, the mechanical actuator configured to mechanically rotate the lens modules in order to scan in a second azimuth, wherein the platform comprises a primary portion and a secondary portion, the secondary portion angled to be offset with respect to the primary portion, and the first phased array is mounted to the primary portion of the platform; and a second phased array of the radio-frequency lens modules mounted to the secondary portion of the platform, wherein the second phased array is angled to be offset with respect to the first phased array.

2. The antenna system of claim 1, wherein the second azimuth and the first azimuth scan over a combined 360 degrees.

3. The antenna system of claim 1, wherein the lens modules are individually tilted in elevation with respect to the actuator towards the first azimuth.

4. The antenna system of claim 1, wherein the platform is configured to be tilted with respect to the actuator toward the first azimuth.

5. The antenna system of claim 4, wherein the lens modules are individually tilted in elevation with respect to the platform towards the first azimuth.

6. The antenna system of claim 1, wherein the lens modules electronically scan in an elevation plane.

7. The antenna system of claim 1, wherein each lens module of the second phased array is tilted in elevation with respect to the first array toward the first azimuth.

8. The antenna system of claim 7, wherein the lens modules of the second phased array are mounted to the said mechanical actuator.

9. The antenna system of claim 7, where the lens modules of the second phased array are mounted on a perimeter of first array.

10. The antenna system of claim 1, wherein the actuator is configured to rotate the platform to provide azimuthal steering of the first phased array and second phase array.

11. The antenna system of claim 1, the primary portion having a first plane and the secondary portion having a second plane, the second plane at an angle between approximately thirty to seventy degrees to the first plane, the secondary portion positioned below and to a side of the primary portion.

* * * * *